US005529299A

United States Patent [19]

Bellagamba

[11] Patent Number: 5,529,299

[45] Date of Patent: Jun. 25, 1996

[54] GOLF ACCESSORY

[76] Inventor: Miro D. Bellagamba, 5161 Vineland Rd., Orlando, Fla. 32811

[21] Appl. No.: 494,669

[22] Filed: Jun. 26, 1995

[51] Int. Cl.[6] ..... A63B 57/00

[52] U.S. Cl. ..... 473/285; 248/156; 248/530; 473/286; 473/406; 473/408

[58] Field of Search ..... 273/32 A, 32 B, 273/32 R, 32 H; 172/378, 379, 380; 248/530, 156

[56] References Cited

U.S. PATENT DOCUMENTS

| | | | |
|---|---|---|---|
| 4,974,842 | 12/1990 | Widman | 273/32 A |
| 5,121,519 | 6/1992 | Haugom | 273/32 A X |
| 5,393,052 | 2/1995 | Kennedy | 273/32 A X |

*Primary Examiner*—George J. Marlo
*Attorney, Agent, or Firm*—William M. Hobby, III

[57] ABSTRACT

A golf accessory apparatus has a divot tool having a removable ball marker attached thereto along with a golf club shaft cradle. The accessory body has a pair of prongs on one end thereof with each prong having a wedged-shaped tip to form a divot tool. The other end of the accessory body has a golf club shaft cradle thereon formed with a pair of lobes forming an arcuate seat therebetween so that when the prongs are pushed into the earth, the golf club can have the shaft laid upon the cradle to keep it off the ground. The golf accessory body also has a ball marker support thereon including an edge opening and a front window in the body. The window allows for removing a ball marker of predetermined shape into the edge slot behind the window and to display the face of the ball marker through the window. The accessory includes a ball marker shaped to fit the accessory body for removable attachment to the body so that the ball marker can be carried in the divot tool and shaft cradle and removed for marking a ball position. The wedged shaped tips of the divot tool prong allows the prongs to be used to clean golf shoe cleats as well as the grooves in the golf clubs. The prongs may be placed at an angle to thereby allow the prongs to be slid under a ball in order to mark the ball.

6 Claims, 1 Drawing Sheet

GOLF ACCESSORY

BACKGROUND OF THE INVENTION

The present invention relates to a golf accessory and especially to a golf accessory having a divot tool with a golf club shaft cradle formed thereon along with a removable ball marker supported on the accessory.

In playing the game of golf, the golfer frequently needs various simple accessories for use on the golf course. The golfer, for instance, needs to be able to clean sod or other materials that have gotten between the cleats in the golfer's shoes and, in addition, to clean dirt that has accumulated in the grooves of a golf club. Materials can be cleaned from the shoes or golf clubs with a pocket knife or other instrument that the golfer may be carrying with him or the golfer may have to wait until he returns to the club house or home to clean the material from the golf club grooves or the shoes.

The golfer also frequently carries a divot tool and, in some cases, carries a golf ball marker. The golfer is allowed to lift the golf ball from the surface of a putting green for cleaning of the ball or to keep it from being a distraction or obstruction to other golfers. A lifted ball must, however, be marked to assure that when it is replaced it will be returned to the same spot from which it was lifted. Not only do the rules of golf permit such ball removal, it is the common practice and courtesy for the golfer to remove and mark the ball and replace it when it becomes his turn to putt. A ball marker must, however, be placed immediately behind the ball unless the mark is placed so that it would interfere with the play, stance or stroke of another golfer. It should then be placed one or more putter lengths to one side. As a result of this common practice, many golfers carry a ball marker in their pocket and some simply employ a coin for this purpose. A great variety of specialized ball markers have been suggested and used. A common ball marker being used is a disk about the size of a dime with a peg or prong extending axially from the planar surfaces of the disk shaped body. When using a ball marker of the usual type, a golfer laterally moves a marker to a position approximate and at least partially under the ball to insure that he does not violate the provisions of the rules relating to placing the marker immediately behind the ball. When in this position, a golfer then presses down on the ball marker to cause a peg to penetrate the surface of the putting green and thereby possibly locate the marker. This same basic marker locating technique is employed when a coin is used and, even though the coin does not have an axial peg, most golfers will press the coin down into the grass to make sure it is lying flat and that it will not be moved by the grass or present an obstruction should another golfer's ball pass over the marker when it is being putted. A golf ball marker can be seen in my prior U.S. Pat. No. 5,356,133 dated Oct. 18, 1994.

Frequently, a golfer will be in a position where he needs to put the club he is using down on the turf adjacent to where he is standing. This, however, is not a desired practice inasmuch as the club can get hidden in the grass or can get moisture and dirt on the shaft and handle of the club. The present invention provides a simple golf accessory which can be carried in the pocket of a golfer or in the golf bag and which provides a divot tool having a pair of prongs for insertion in the turf which has a golf club shaft cradle formed on the other end thereof so that when the prongs are pushed in the ground, the golf club can be laid such that the shaft of the club fits in the cradle protruding above the sod to keep the handle and shaft off of the turf. In addition, the accessory of the present invention supports a golf ball marker which is removably attached thereto behind a window where the marker is visible and where a design or logo may be placed for display through the window. Finally, the golf accessory, in accordance with the present invention, is shaped for marking the ball as well as for cleaning sod or dirt from the golfer's shoes between the cleats and for cleaning out dirt or other materials that may have gotten in the grooves on the face of the golf club and repairing a ball divot.

SUMMARY OF THE INVENTION

A golf accessory apparatus has a divot tool having a removable ball marker attached thereto along with a golf club shaft cradle. The accessory body has a pair of prongs on one end thereof with each prong having a chisel point or wedged-shaped tip to form a divot tool. The other end of the accessory body has a golf club shaft cradle thereon formed with a pair of lobes forming an arcuate seat therebetween so that when the prongs are pushed into the earth, the golf club can have the shaft grip end laid upon the cradle to keep it off the ground. The golf accessory body also has a ball marker support thereon including an edge opening and a front window in the body. The window allows for removing a ball marker of predetermined shape into and out of the edge slot behind the window and to display the face of the ball marker through the window. The accessory includes a ball marker shaped to fit the accessory body for removable attachment to the body so that the ball marker can be carried in the divot tool and shaft cradle and removed for marking a ball position. The wedged shaped tips of the divot tool prong allows the prongs to be used to clean golf shoe cleats as well as the grooves in the golf clubs. The prongs may be placed at an angle to thereby allow the prongs to be slid under a divot or ball mark on the green caused by the ball striking the green and creating an indenture or hole which needs repairing.

BRIEF DESCRIPTION OF THE DRAWINGS

Other objects, features, and advantages of the present invention will be apparent from the written description and the drawings in which.

DESCRIPTION OF THE PREFERRED EMBODIMENT

Figure 1:
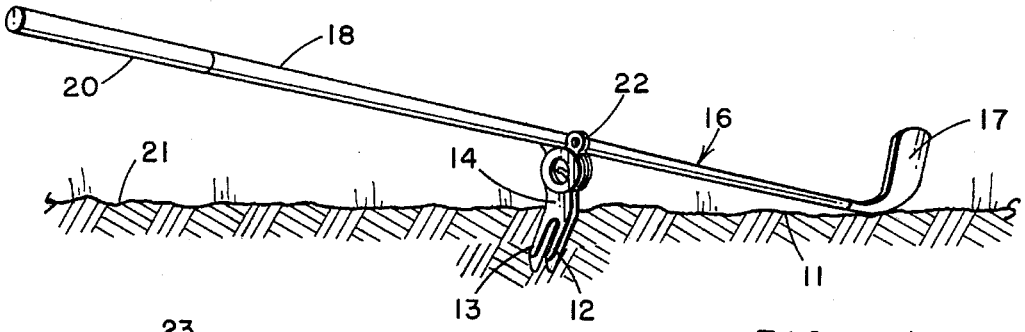
FIG. 1 is a sectional view through a piece of sod having the golf accessory of the present invention supporting a golf club shaft thereon.
Figure 2:
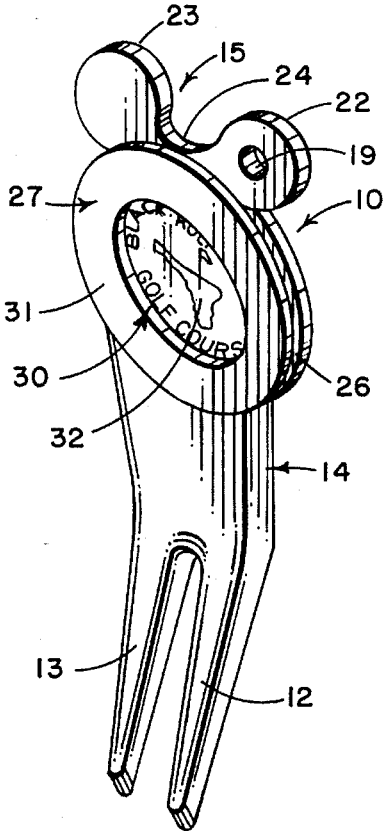
FIG. 2 is a perspective view of the golf accessory in accordance with the present invention having a ball marker therein.
Figure 3:
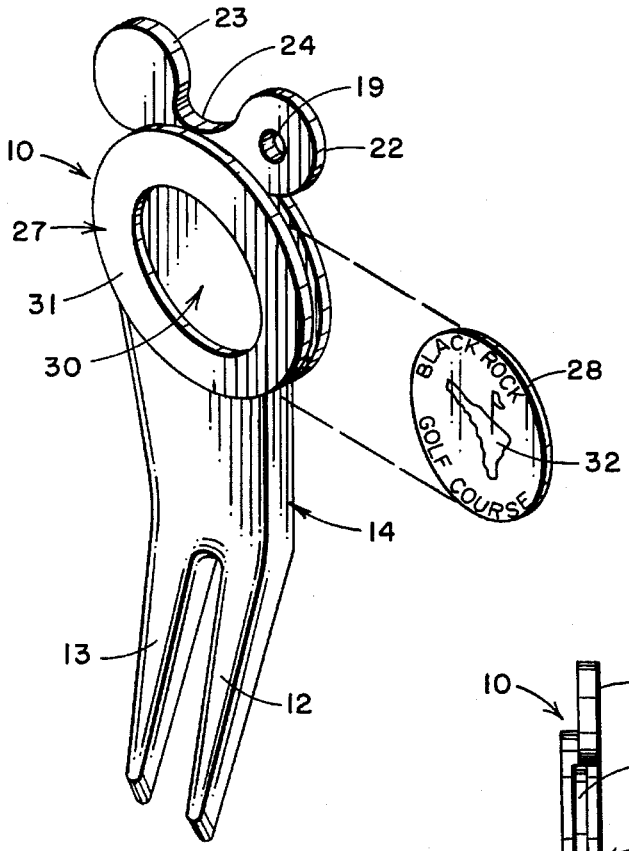
FIG. 3 is a perspective view of the golf accessory of FIG. 2 having the ball marker removed therefrom.

Referring to the drawings, FIGS. 1–5, a golf accessory 10 is illustrated in FIG. 1 inserted into the sod 11. The accessory 10 has a pair of prongs 12 and 13 on one end of the accessory body 14 and has a golf club shaft cradle 15 on the other end of the body 14. A golf club 16 having a golf club head 17, a shaft 18 and a handle 20 has been laid across the cradle 15, as shown in FIG. 1, to support the shaft and the handle above the surface 21 of the sod 11. The accessory 10 golf club shaft cradle 15 is made up of a pair of lobes 22 and 23 forming an arcuate surface 24 therebetween shaped and sized to support a shaft 18 of a golf club 16. Because of the curved surfaces on the lobes 22 and 23, the cradle portion 24 can support a variety of sizes of shafts 18 of different golf clubs 16 and tends to guide the shaft into the cradle portion 24. The lobe 22 has an aperture 19 therein for a key chain or the like. The golf accessory 10 prongs 12 and 13 each have a wedged shape tip 25 which is specifically shaped so as to allow the cleaning of grooves in the golf club as well as to be able to clean out dirt and the like caught in the cleats of the golfer's shoes. The prongs 12 and 13 are also angled forward from the rest of the body 14, as can be more clearly seen in FIG. 5. A preferred angle might be approximately 30° and this allows the prongs 12 and 13 to be slid under the ball mark indenture caused by the golf ball striking the green from a distance.

Figure 4:
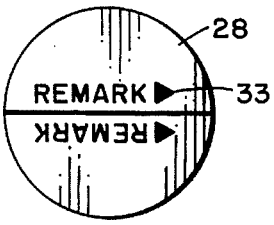
FIG. 4 is a rear elevation of the ball marker of FIG. 3.
Figure 5:
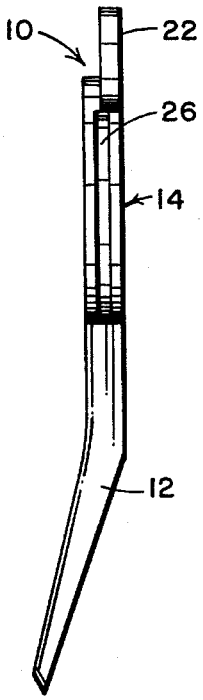
FIG. 5 is a side elevation of the golf accessory of FIGS. 2 and 3.

The golf accessory 10 has an edge slot 26 in an enlarged portion 27 of the body 14 that allows a ball marker 28 to be slid into the edge slot 26 and to be supported behind a front window 30. The front window 30 is a cutout from the front face 31 of the enlarged portion 27 of the body 14. Thus, sliding the ball marker 28 into the side opening or slot 26 positions it so that a design 32 on the face of the ball marker 28 is positioned for viewing through the window 30. This advantageously allows for promotional material to be placed for viewing in the window which could include a golf clubs' logo and name or, alternatively, advertising material for a corporation. The back of the ball marker 28, as shown in FIG. 4, can have a ball marking arrow 33 thereon or other indicia as desired. The arrows allow the user of the ball marker to indicate the position for replacing the ball after it has been lifted.

The body 14 of the present golf accessory may be made of any material desired but one preferred material would be a plastic, such as a polycarbonate polymer, and the ball marker 28 might be made of a metal, such as brass having an enamel coating thereon. The insertion of the metal ball marker 28 into the polymer body 14 slot 26 allows a slight expansion of the supporting slot to provide a natural pressure to hold the ball marker 28 within the accessory 10 displayed through the window 30. The ball marker can be removed by simply placing a finger or thumb through the window 30 and pushing on the ball marker 28 to remove it from the accessory body 14. The body 14 of the golf accessory 10 can also be made of a metal, such as brass, in which case the metal adjacent the slot 27 can hold the ball marker 28 in place and still be removed by inserting the finger in the window 30 to push upon the ball marker 28 to remove it for marking a ball on a golf course. The metal adjacent the slot 27 can have a portion removed to allow edges adjacent the removed portion to hold the ball marker 28 in place.

It should be clear at this time that a golf accessory has been provided which has a divot tool formed on one end thereof and a golf club shaft cradle on the other end thereof while having a removable ball marker supported thereon within the body of the golf accessory and which is positioned to display the ball marker face which might have a design thereon. It should also be clear that the present golf accessory is specifically designed to perform a number of other functions including the cleaning of material, such as dirt, from between the cleats of the golf shoes and the cleaning of the grooves within a golf club. Accordingly, the present invention is to be considered illustrative rather than restrictive.

I claim:

1. A golf accessory apparatus having a divot tool and removable ball marker and golf club shaft cradle comprising:

an elongated body having a pair of prongs on one end thereof each having a wedge shaped tip to form a divot tool, said body having front and rear sides and a plurality of edges and said body having a golf club shaft cradle on the other end thereof formed with a pair of lobes forming an arcuate seat therebetween, said cradle having an opening in of said lobes for attaching a keychain, and said body having a ball marker support thereon including an edge opening located to one side of said golf club shaft cradle and said elongated body having a front window in said elongated body for removably sliding a ball marker of predetermined shape in said opening behind said window; and a ball marker having two sides and predetermined printed images on each side thereof for displaying one of said images in said window and being shaped to fit in said elongated body ball marker support edge opening behind said window opening for removable attachment to said elongated body, whereby a ball marker can be carried in a divot tool and shaft cradle and removed for marking a ball position.

2. A golf accessory apparatus having a divot tool and removable ball marker and golf club shaft cradle in accordance with claim 1 in which said elongated body is made of polymer material.

3. A golf accessory apparatus having a divot tool and removable ball marker and golf club shaft cradle in accordance with claim 2 in which said elongated body is made of polycarbonate polymer.

4. A golf accessory apparatus having a divot tool and removable ball marker and golf club shaft cradle in accordance with claim 1 in which said elongated body is made of brass.

5. A golf accessory apparatus having a divot tool and removable ball marker and golf club shaft cradle in accordance with claim 1 in which said elongated body prongs are angled from the rest of said body for slipping said prongs under a golf ball when marking a golf ball position.

6. A golf accessory apparatus having a divot tool and removable ball marker and golf club shaft cradle in accordance with claim 5 in which said prongs are angled from the rest of said body by about 30 degrees.

* * * * *